United States Patent [19]

Saint-Amand

[11] Patent Number: 4,563,104

[45] Date of Patent: Jan. 7, 1986

[54] LIQUID DISPENSING PIPETTE AND STIRRER DEVICE

[75] Inventor: Elmer Saint-Amand, San Fernando, Calif.

[73] Assignee: Saint Amand Manufacturing, Inc., San Fernando, Calif.

[21] Appl. No.: 493,017

[22] Filed: May 9, 1983

[51] Int. Cl.[4] ..... B65D 47/18

[52] U.S. Cl. ..... 401/139; 401/266; 401/183; 401/184; 222/192; 222/209; 222/420

[58] Field of Search ..... 222/420, 421, 191, 192, 222/209, 206, 214, 215, 416; 401/52, 195, 266, 183, 184; 73/864.11; 604/27, 30, 35, 75, 118, 119, 289, 290, 294, 297–299, 313, 314, 316; 422/99, 100

[56] References Cited

U.S. PATENT DOCUMENTS

| | | | |
|---|---|---|---|
| 2,517,027 | 8/1950 | Rado | 401/183 |
| 3,276,639 | 10/1966 | Lancaster | 222/421 |
| 3,811,603 | 5/1974 | Felton | 222/420 |
| 3,834,241 | 9/1974 | Garren | 222/209 X |
| 4,118,195 | 10/1978 | Beach | 73/486.11 X |
| 4,212,204 | 7/1980 | St. Amand | 222/420 X |

FOREIGN PATENT DOCUMENTS

| | | | |
|---|---|---|---|
| 13197 | of 1892 | United Kingdom | 222/206 |

*Primary Examiner*—Joseph J. Rolla
*Assistant Examiner*—Kevin P. Shaver
*Attorney, Agent, or Firm*—James E. Brunton

[57] ABSTRACT

A disposable liquid dispensing pipette and method of making same which delivers an accurate and uniform drop of liquid of a given size and which incorporates an integral paddle stirrer, so that a chemical or biological sample can be dispensed and spread or mixed before disposing of the device. The device comprises a hollow drawing and dispensing tube connected to a flexible and resilient bulb and paddle stirrer. The open end of the tube can be made in various sizes (i.e. outside diameter) to accommodate different drop size required. The device can be fabricated inexpensively, such as by molding from polyethylene which is generally hydrophobic, non-toxic and inert to most chemicals found in a clinical laboratory.

8 Claims, 11 Drawing Figures

LIQUID DISPENSING PIPETTE AND STIRRER DEVICE

BACKGROUND OF THE INVENTION

1. Field of the Invention

The present invention generally relates to dispensers and more particularly to an inexpensive (i.e. disposable) dispensing device and the method of making the device which delivers an accurate and uniform drop of liquid of a given size (i.e. 30, 40, or 50 microliters) and which includes an integral paddle stirrer. This device is very useful with a number of tests that require a small amount of liquid to be dispensed and spread over an area or mixed with another sample.

2. Discussion of the Prior Art

Various types of devices are known for dispensing liquids in the form of drops or definite volumetric quantity, such as standard glass and plastic pasteur pipettes, serological pipettes, calibrated capillary tubes, conventional medicine or eye droppers, air and positive displacement pipettes and syringes. These devices are somewhat inaccurate or expensive and do not incorporate a paddle stirrer. Therefore, they are generally unsuitable for this application.

U.S. Pat. No. 3,811,603 granted May 21, 1974 to L. C. Felton, disclosed a combined disposable liquid dropper and stirrer. The device, however, has certain disadvantages. Liquid is drawn into the tube and dispensed from the tube by grasping the tube at any point along its length and squeezing it between two fingers. Since the size of fingers can vary considerably from one person to another it is apparent that the amount of liquid drawn into the tube and the size of the drop will vary accordingly. The drop size variations of this device can be seen from the graphic illustration in drawing FIG. 5 of the above numbered patent. This device according to its claims and description is also limited to a single drop.

Other U.S. Patents of which the present inventor is aware and which comprise the most pertinent art known to the inventor are as follows: U.S. Pat. Nos. D228,492 issued to Cohen; D250,599 and D260,434 issued to the present inventor; 2,129,627 issued to Sands; 2,656,070 isued to Linder; 3,834,241 issued to Garren; and 4,212,204 issued to the present inventor.

SUMMARY OF THE INVENTION

The invention relates to a plastic pipette which incorporates an integral paddle stirrer and is capable of delivering an accurate and uniform drop of liquid of a given size such as 30, 40, or 50 microliters, but not necessarily limited to these sizes. The device comprises a hollow tube which is open, and molded or cut at right angle to its longitudinal axis at one end to draw or dispense liquid therefrom. The open end of the tube can be made with various size (i.e. outside diameter) to deliver the drop size required. The opposite end of the tube is connected to a hollow, flexible and resilient bulb which is used to draw the liquid in the tube or to dispense the liquid out of the tube. The paddle stirrer extends from the bulb along the longitudinal axis of the tube and bulb. In one embodiment of the invention a stiffening element is disposed at the junction line of the bulb and the paddle. This stiffening element comprises an elongated hollow extension from the bulb, said hollow extension being smaller in size than the bulb itself. The stirrer-paddle is disposed around the stiffening element. The tubular extension which forms the stiffening element also serves as a reservoir for the excess plastic material which results during the molding of the flat section of the paddle. The containment of the excess plastic, within the stiffening element, improves the resiliency and function of the bulb when the device is being used.

The device of the invention is used in the same manner as a standard plastic pipette for drawing and dispensing a liquid. During the dispensing step the pipette is preferably held vertically so that drop size will be accurate and uniform. During the spreading or mixing step, the device is preferably held at or near the bulb with the paddle directed away from the hand.

Generally, the bulb is designed to draw slightly more than the volume required for a particular test or application. This assures that there will always be a sufficient amount of solution or sample for the test being performed. The bulb can be designed to accommodate one or more drops. The bulb being relatively small, i.e. approximately 0.238 inch diameter and 0.550 inch in length, provides better control when delivering a drop of liquid than standard transfer pipettes which are normally several times larger.

The unique ability of the device of the present invention to precisely control drop size is vividly illustrated in FIGS. 10 and 11 and discussed in the paragraphs which follow.

DESCRIPTION OF THE INVENTION

Figure 1:
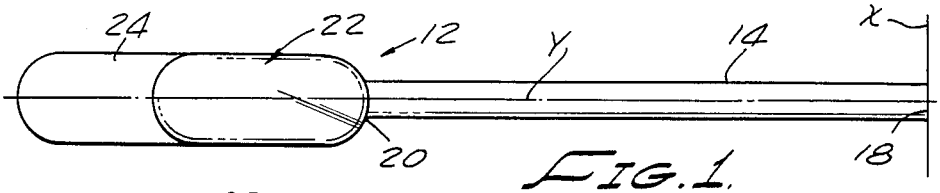
FIG. 1 is a top plan view of one embodiment of the pipette of the present invention with integral paddle-stirrer.
Figure 2:
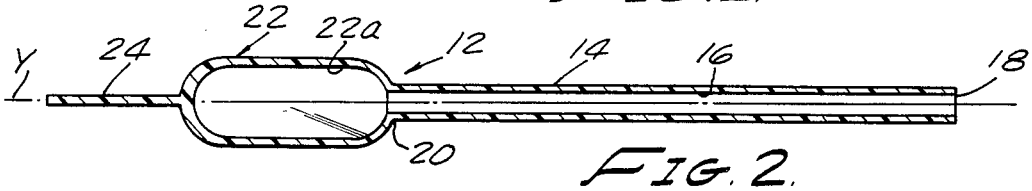
FIG. 2 is a side sectional view of the pipette illustrated in FIG. 1 showing excess material from the paddle accumulated at the closed end of the bulb.

Referring to the drawings and particularly to FIGS. 1 and 2, one form of the liquid dispensing and spreading device, or pipette, of the present invention generally designated by the numeral 12 comprises an elongated hollow tube 14 having a centrally disposed, axially extending fluid passageway 16 (FIG. 2) and first and second ends 18 and 20 respectively. First end 18 is open to atmosphere and is located within a plane X which extends perpendicularly to the longitudinal axis Y of the tube 14.

A yieldably deformable hollow bulb 22 is connected to second end 20 of tube 14 with the interior of the bulb 22*a* being in communication with the fluid passageway 16 of the tube 14.

A flexible, generally planar paddle 24 is connected to bulb 22 and is disposed within a plane, the center of which is coplanar with the plane containing the longitudinal axis of tube 14. For example, as best seen in FIG. 2, the plane of the paddle 24 is perpendicular to the plane of the paper with the center of said plane being coplanar with the plane containing the longitudinal axis Y of the tube 14 and of the bulb 22. The paddle 24 may be of varying thickness depending upon the end application of the device, but the central plane thereof is always molded coplanar with the plane containing the longitudinal axis Y of the device.

Figure 3:
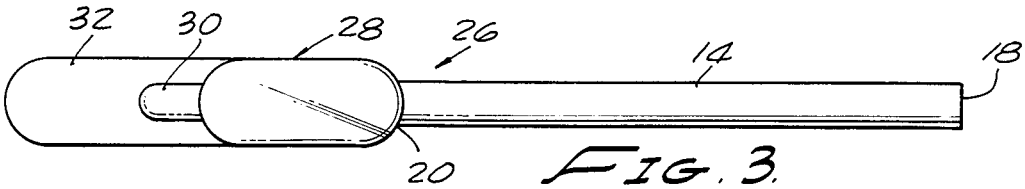
FIG. 3 is a top plan view of another embodiment of the invention comprising a pipette with integral paddle-stirrer and incorporating a stiffening element.
Figure 4:
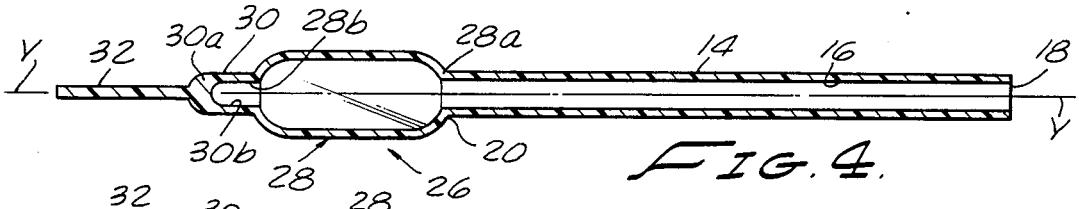
FIG. 4 is a side sectional view of the embodiment illustrated in FIG. 3 showing excess material from the paddle accumulated in the stiffening element.

Turning now to FIGS. 3 and 4 of the drawings, another embodiment of the device of the present invention is there illustrated and generally designated by the numeral 26. The device of this form of the invention is generally similar to that shown in FIGS. 1 and 2 and like numerals are used to designate like component parts of the device. As in the earlier described embodiment, the device of this form of the invention includes an elongated hollow tube 14 having a centrally disposed, axially extending fluid passageway 16 and first and second ends 18 and 20.

The form of the device shown in FIGS. 3 and 4 also includes a yieldably deformable hollow bulb 28 connected at a first location 28*a* to second end 20 of tube 14 with the interior of the bulb being in communication with the fluid passageway 16 of the tube. Bulb 28 is also provided with an aperture 28*b* formed therein at a second location axially spaced from first location 28*a*.

A unique aspect of the device of the invention shown in FIGS. 3 and 4 comprises a hollow stiffening section 30 which is closed at one end 30*a* and is connected at its opposite end 30*b* with the bulb 28 so that the interior 30*b* of stiffening section 30 is in communication with the interior of the bulb 28.

In this second form of the invention, the flexible, generally planar paddle 32 encompasses stiffening section 30 (FIG. 3) and also is disposed in a plane, the center of which is coplanar with the plane containing the longitudinal axis Y of the stiffening section 30 and of the tube 14. As will be discussed in greater detail hereinafter, in this form of the invention, the stiffening section 30 is formed at least in part from the excess plastic material which is extruded from the planar paddle portion 32 during the molding process. The unique configuration of the paddle 32 which, as best seen in FIG. 4, extends about the stiffening section 30 as well as extending forwardly therefrom, substantially improves the resiliency and function of the bulb 28 and stiffening section 30 when the device is being used in drawing and dispensing liquid.

Figure 5:
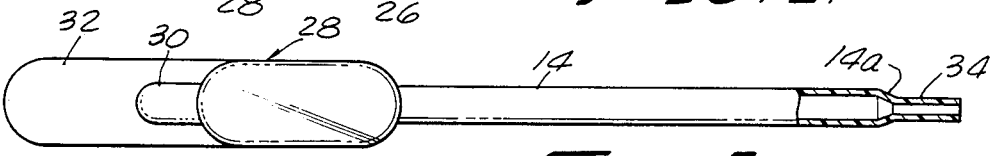
FIG. 5 is a top plan view of another form of the device of the invention which device is similar to that shown in FIG. 3, but having a reduced diameter dispensing tip (shown partly in section) to obtain a small drop size while retaining a larger drawing tube to maintain overall rigidity of the device during use.

A further form of the device of the present invention is shown in FIG. 5. This device is similar in construction to that shown in FIGS. 3 and 4 and like numerals are used to designate like portions. However, in the form of the invention shown in FIG. 5, the hollow tube 14 is provided with a reduced diameter portion 34 which is located proximate the first end 14*a* of the device. This reduced diameter portion has a diameter about one half the diameter of the tube body. However, the diameter of this portion can vary depending upon the end use application of the device.

As clearly illustrated in FIG. 5 the end portion of the tube 14 designated by the numeral 14*a* is necked down so as to blend uniformly with the reduced diameter end portion 34. As will be discussed in the paragraphs which follow, the device of the invention as shown in FIGS. 1 through 4 is adapted to dispense drops of liquid having a volume of between about 40 and about 60 microliters. Whereas the device as shown in FIG. 5 is adapted to uniformly and precisely dispense drops of liquid having a volume of between approximately 15 and approximately 45 microliters.

Figure 6:
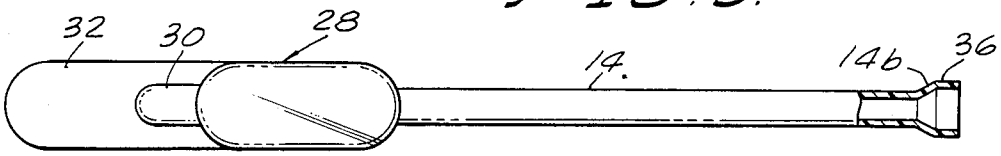
FIG. 6 is a top plan view of still another embodiment of the invention which is similar to the device shown in FIG. 5 but having a dispensing tip of increased diameter to obtain a larger drop size without increasing the drawing tube diameter to the bulb diameter to avoid drawing an excessive amount of liquid.

Turning now to FIG. 6, there is shown yet another embodiment of the device of the present invention. This device is similar to that shown in FIGS. 1 through 4 but is provided with a tube 14 having an enlarged diameter end portion 36 which is about twice the diameter of the tube 14. This device, which also has an integrally formed bulb 28, stiffening element 30 and paddle 32, includes radially outwardly extending walls at 14*b* which smoothly interconnect with the walls of enlarged diameter portion 36. The device of the form of the invention shown in FIG. 6 is adapted to uniformly and precisely dispense drops of liquid having a volume of between approximately 50 and 70 microliters of fluid. Once again the diameter of portion 36 can be varied to meet various end product requirements.

Figure 7:
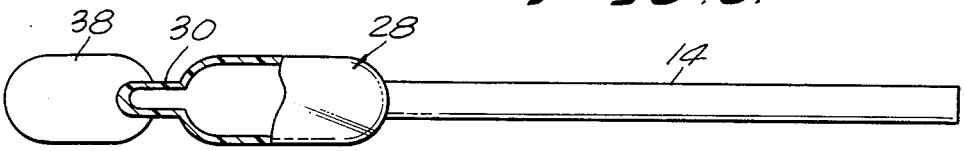
FIG. 7 is a top plan view of a further embodiment of the device of the invention which is similar to the device shown in FIG. 3 but having a modified paddle-stirrer design.

Turning now to FIG. 7, another embodiment of the invention is thereshown. This embodiment of the invention is similar to that shown in FIG. 4 and like numerals are used to designate like portions of the device. In this form of the device, however, the paddle portion 38 is differently configured, in that the paddle does not totally encompass the stiffening section 30 but rather encompasses only the forward portion thereof.

Figure 8:
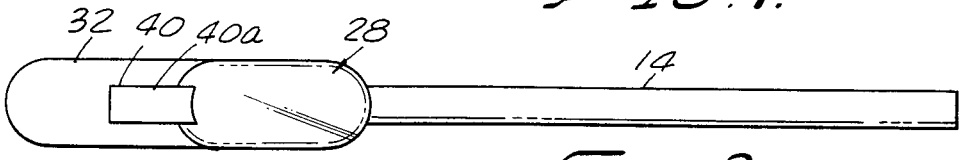
FIG. 8 is a top plan view of another form of the invention, which is also similar to that shown in FIG. 3 but having a modified stiffening element.
Figure 9:
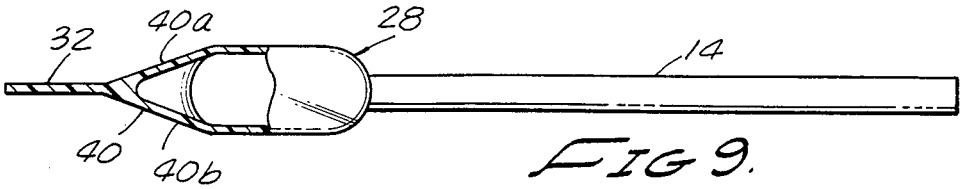
FIG. 9 is a side view of the device of FIG. 8 partly in section to show the excess material from the paddle accumulated in the modified stiffening element.

Referring now to FIGS. 8 and 9, there is shown still another embodiment of the device of the present invention. This device is similar to that shown in FIGS. 3 and 4 and once again like numerals will be used to designate like portions of the device. As can best be seen by referring to FIG. 9, in this embodiment of the invention the hollow stiffening section 40 is of a different non-cylindrical configuration having side walls 40*a* and 40*b* tapering downwardly toward and interconnecting with the paddle section 32. This configuration provides a slightly larger liquid volume within the stiffening portion 40 and also provides somewhat greater rigidity than do the stiffening portions 30 of earlier discussed embodiments.

In all cases, the devices of the present invention as illustrated in the drawings are preferably integrally formed of an unsaturated hydrocarbon material selected from the polyolefin group. The hydrocarbon materials of this group which have provided the best results are polyethylene and polypropylene, although other members of the group can be used to satisfy particular end product applications of the device.

Figure 10:
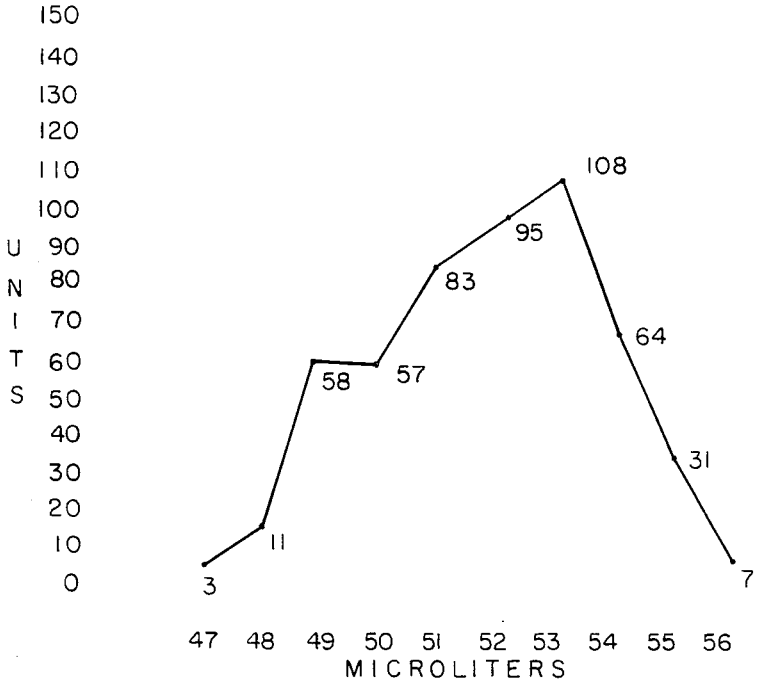
FIGS. 10 and 11 are graphs which represent the accuracy and uniformity of the drop size of a number of articles of the present invention.

As earlier mentioned, the device of the present invention as described in the previous paragraphs has the unique ability to precisely control the drop size of the fluid which is to be deposited onto a selected surface. This unique capability and the remarkable uniformity of deposited drop size is vividly demonstrated in FIGS. 10 and 11. Referring to these figures, FIG. 10 is a graph which represents the accuracy and uniformity of the drop size of 516 articles of the present invention which were tested under controlled laboratory conditions. In FIG. 10 drop size is shown in microliters and the device tested is adapted to dispense drops of liquid having a volume within the 50 microliter range. It is to be understood that devices within the scope of the invention can be constructed to dispense drop sizes as large as 70 microliters and as small as 15 microliters.

Figure 11:
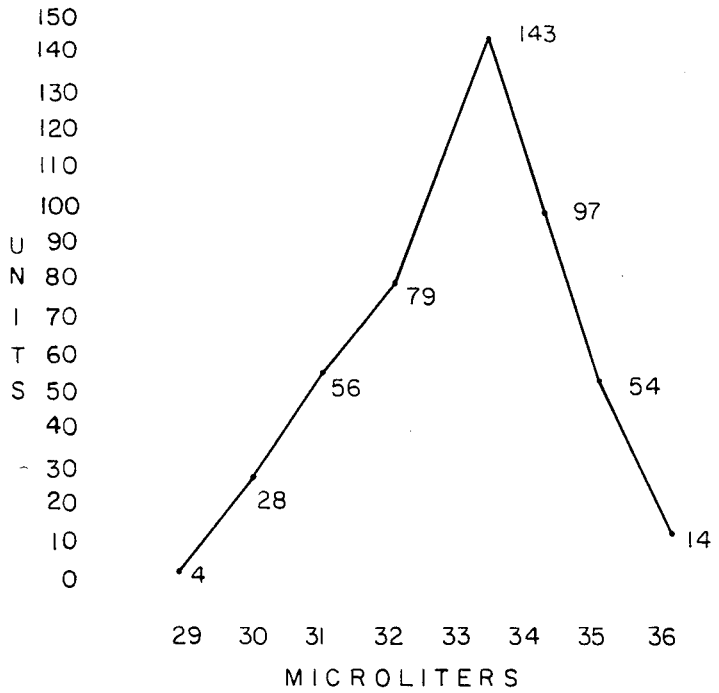

FIG. 11 is a graph which represents the accuracy and uniformity of drop size of 475 units exemplary of the present invention which were actually tested under controlled laboratory conditions. These articles were adapted to dispense drops of liquid having a volume of on the order of 35 microliters.

A study of both FIGS. 10 and 11 clearly demonstrates the uniformity of performance of the devices of the invention and demonstrates their unique capability to precisely and repeatedly dispense drops of liquid of a predetermined desired volume.

The method of the present invention for producing a one piece, integrally molded pipette for use in uniformly dispensing one or more drops of liquid of a precise volume onto a surface and for then uniformly and expeditiously spreading the dispensed liquid over the surface, comprises the following steps. Using a stretchable plastic material selected from the polyolefin group and preferably polyethylene, a device according to the present invention is molded so as to have an elongated hollow tubular portion, a hollow bulb portion attached to one end of said tubular portion, a hollow stiffening section attached to and interiorly communicating with said bulb and a planar paddle extending from said stiffening section and being disposed within a plane, the center of which is coplanar with the plane containing the longitudinal axis of said tube. Uniquely, and in accordance with the method of the invention, the stiffening section of the molded device is formed at least in part from the excess plastic material extruded from the planar paddle during the molding process. By controlling this excess material so that the planar paddle is molded in a manner as to encompass the stiffening section, the resiliency and function of the bulb and the stiffening section is markedly improved when the device is being used in its various end product applications.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A liquid dispensing and spreading device for use in uniformly dispensing one or more drops of liquid of a precise, predetermined volume onto a surface and for uniformly spreading the dispensed liquid over the surface, said device comprising:

(a) an elongated hollow tube having a centrally disposed, axially extending fluid passageway and first and second ends, said first end being open and located within a plane extending perpendicularly to the longitudinal axis of said tube;

(b) a yieldably deformable hollow bulb connected at a first location to said second end of said tube, the interior of said bulb being in communication with said fluid passageway of said tube, said bulb having an aperture formed therein at a second location axially spaced from said first location;

(c) a generally cylindrically shaped hollow stiffening section closed at one end and connected at the other end to said bulb at said second location, the interior of said stiffening section being in communication with the interior of said bulb; and (d) a flexible, generally planar paddle disposed about said stiffening section and within a plane the center of which is co-planar with the plane containing the longitudinal axis of said stiffening section and of said tube.

2. A device as defined in claim 1 in which said hollow tube is provided with a reduced diameter portion located proximate said first end thereof whereby drops of liquid having a volume between 15 microliter and 45 microliters can be dispensed onto said surface.

3. A device as defined in claim 1 in which said hollow tube is provided with an enlarged diameter portion located proximate said first end thereof.

4. A device as defined in claim 1 in which said tube, said bulb and said paddle have a wall thickness of between 0.014 inches and 0.022 inches.

5. A device as defined in claim 1 in which said stiffening section includes side walls tapering downwardly toward said paddle section.

6. A device as defined in claim 1 in which said tube, said bulb, said stiffening section and said paddle are integrally formed of an unsaturated hydrocarbon material selected from the polyolefin group.

7. A device as defined in claim 6 in which said material is polyethylene.

8. A liquid dispensing and spreading device for use in uniformly dispensing one or more drops of liquid of a precise, predetermined volume onto a surface and for uniformly spreading the dispensed liquid over the surface, said device comprising:

(a) an elongated hollow tube having a centrally disposed, axially extending fluid passageway and first and second ends, said first end being open and located within a plane extending perpendicularly to the longitudinal axis of said tube;

(b) a yieldably deformable hollow bulb connected at a first location to said second end of said tube, the interior of said bulb being in communication with said fluid passageway of said tube, said bulb having an aperture formed therein at a second location axially spaced from said first location; and (c) a hollow stiffening section closed at one end and connected at the other end to said bulb at said second location, the interior of said stiffening section being in communication with the interior of said bulb, said hollow stiffening section comprising an elongate tubular extension having parallel walls; and (d) a flexible, generally planar paddle disposed about and extending along said stiffening section and within a plane the center of which is co-planar with the plane containing the longitudinal axis of said stiffening section and of said tube, said planar paddle having side walls disposed on either side of said hollow stiffening section.

* * * * *